US007387174B2

(12) United States Patent
Lurie

(10) Patent No.: US 7,387,174 B2
(45) Date of Patent: Jun. 17, 2008

(54) DEVICE AND METHOD OF LINING A WELLBORE

(75) Inventor: Paul George Lurie, East Horsley (GB)

(73) Assignee: BP Exploration Operating Company Limited, Middlesex (GB)

( * ) Notice: Subject to any disclaimer, the term of this patent is extended or adjusted under 35 U.S.C. 154(b) by 188 days.

(21) Appl. No.: 10/570,496

(22) PCT Filed: Aug. 26, 2004

(86) PCT No.: PCT/GB2004/003667

§ 371 (c)(1),
(2), (4) Date: Mar. 3, 2006

(87) PCT Pub. No.: WO2005/024178

PCT Pub. Date: Mar. 17, 2005

(65) Prior Publication Data

US 2007/0017669 A1 Jan. 25, 2007

(30) Foreign Application Priority Data

Sep. 8, 2003 (GB) ..... 0320979.8

(51) Int. Cl.
*E21B 7/20* (2006.01)
*E21D 9/00* (2006.01)

(52) U.S. Cl. ..... 175/57; 175/171; 405/146

(58) Field of Classification Search ..... 166/380, 166/207, 242.2, 177.4; 175/171, 52, 78; 405/146

See application file for complete search history.

(56) References Cited

U.S. PATENT DOCUMENTS 2,927,775 A * 3/1960 Hildebrandt ..... 175/226
3,927,164 A * 12/1975 Shimabukuro ..... 264/558
4,064,211 A * 12/1977 Wood ..... 264/516
4,077,610 A * 3/1978 Masuda ..... 254/134.4
4,202,531 A * 5/1980 Hamrick ..... 254/134.4
4,522,125 A * 6/1985 Marz ..... 102/313
5,169,264 A * 12/1992 Kimura ..... 405/184
5,176,207 A * 1/1993 Keller ..... 166/64
5,577,864 A * 11/1996 Wood et al. ..... 405/184.2
5,803,666 A * 9/1998 Keller ..... 405/146
5,816,345 A * 10/1998 Keller ..... 175/53
5,853,049 A * 12/1998 Keller ..... 166/380

(Continued)

FOREIGN PATENT DOCUMENTS

GB 2 357 305 A 6/2001
WO WO 90/10173 9/1990

*Primary Examiner*—David J. Bagnell
*Assistant Examiner*—Cathleen R Hutchins
(74) *Attorney, Agent, or Firm*—Nixon & Vanderhye

(57) ABSTRACT

A method of sealing the wall of a wellbore (1) as it is being drilled through a subterranean formation using a drill string (3) having a drill bit (4) on the lower end thereof comprises fitting to the lower end of a drill string (3) a device comprising (i) a cylindrically gathered pack of flexible tubing (6), (ii) a receptacle (5) for the gathered pack and (iii) a radially expandable locking means (8) having a first end of the tubing of the gathered pack connected either directly or indirectly thereto, and drilling a first section of wellbore, expanding the locking means (8) against the wellbore wall such that the first end of the tubing that is withdrawn from the gathered pack is locked in place in the wellbore, drilling a second section of wellbore with the movement of the drill string (3) through the wellbore causing the tubing to be withdrawn from the gathered pack (6) and to be turned inside out thereby forming a liner for the second section of wellbore.

7 Claims, 1 Drawing Sheet

U.S. PATENT DOCUMENTS 5,993,114 A * 11/1999 Jones ..... 405/150.1
6,109,828 A * 8/2000 Keller ..... 405/146
6,953,307 B2 * 10/2005 Graham ..... 405/184.1
7,044,241 B2 * 5/2006 Angman ..... 175/61
7,281,422 B2 * 10/2007 Keller ..... 73/152.41
2004/0065438 A1 * 4/2004 Keller ..... 166/250.03
2005/0172710 A1 * 8/2005 Keller ..... 73/152.41
2007/0144784 A1 * 6/2007 Head et al. ..... 175/57

* cited by examiner

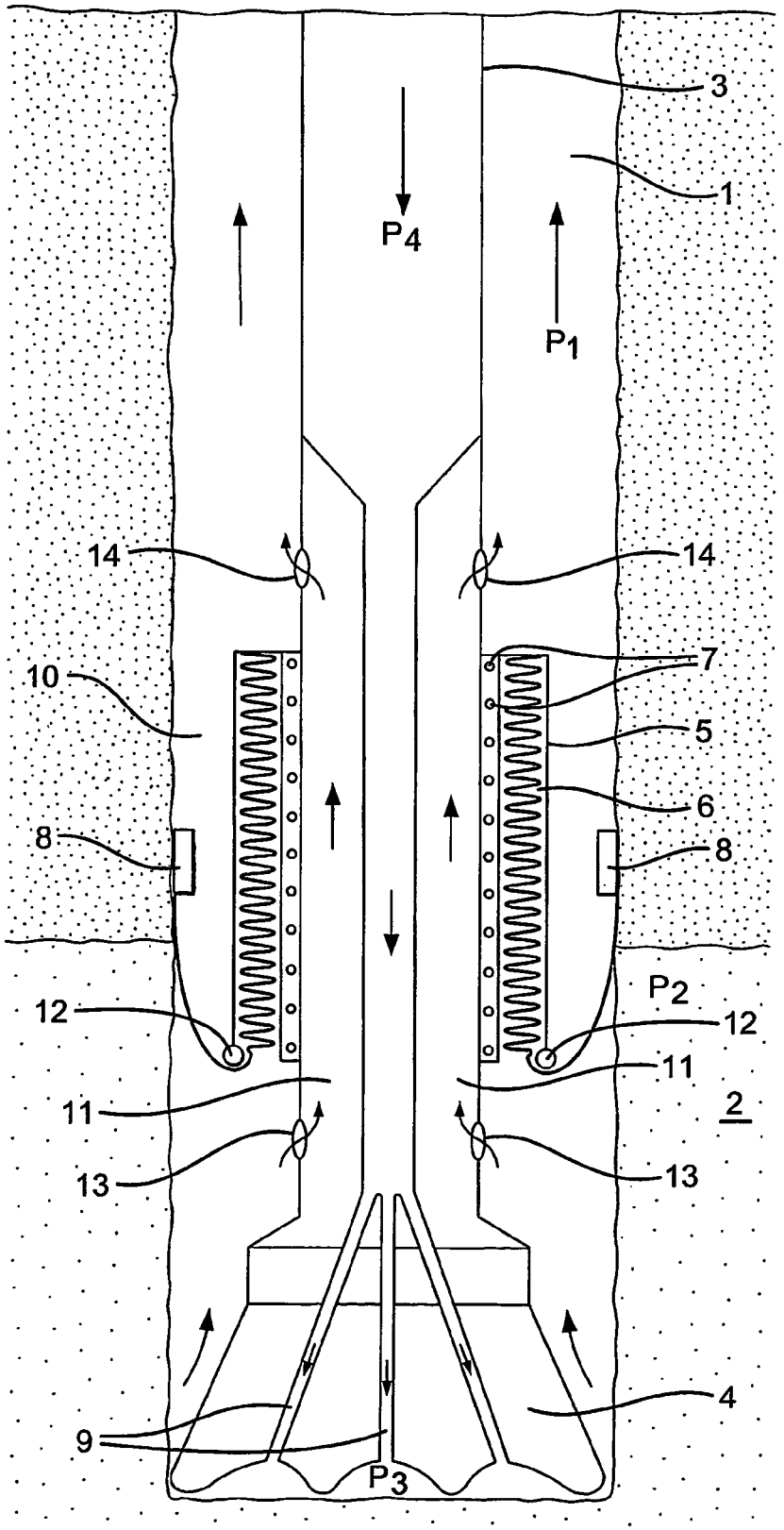
3
1
P4
P1
14
14
7
10
5
6
8
8
P2
12
12
11
11
2
13
13
4
9
P3

DEVICE AND METHOD OF LINING A WELLBORE

This application is the U.S. National Phase of International Application PCT/GB20041003667, filed 26 Aug. 2004, which designated the U.S. PCT/GB2004/003667 claims priority to British Application No. 0320979.8 filed 8 Sep. 2003. The entire content of these applications are incorporated herein by reference.

The present invention relates to drilling of wells through a hydrocarbon bearing subterranean formation, and more particularly to a method of lining a wellbore wall as it is being drilled and to a device suitable for use in the method.

In the drilling of a wellbore through a subterranean formation by rotary drilling techniques, conventionally a drilling fluid is circulated from the surface of the earth down a drill string having a drill bit on the lower end thereof and through ports provided in the drill bit to the well bottom and thence back to the surface through the annulus formed about the drill string. Commonly, drilling fluids are employed that are either oil or water based. These fluids are treated to provide desired Theological properties which make the fluids particularly useful in the drilling of wellbores.

A problem often encountered in the drilling of a well bore is the loss of unacceptably large amounts of drilling fluid into the subterranean formation penetrated by the wellbore. This problem is often referred to generally as "lost circulation", and the formation zones into which the drilling fluid is lost are often referred to as "lost circulation zones" or "thief zones". Various causes may be responsible for the lost circulation encountered in the drilling of a wellbore. For example, a formation penetrated by the wellbore may exhibit unusually high permeability or may contain fractures or crevices therein. In addition, a formation may simply not be sufficiently competent to support the hydrostatic pressure applied by the drilling fluid and may break down under this hydrostatic pressure and allow the drilling fluid to flow thereinto.

The present invention relates to a device and method for lining the wall of a borehole that is being drilled through such "lost circulation" or "thief" zones thereby preventing loss of drilling fluid from the wellbore into the formation. Although the present invention is particularly suitable for lining lost circulation zones, it will be apparent that it may be used in other sections of the well bore.

Thus, in a first embodiment of the present invention there is provided a device for lining the wall of a wellbore as it is being drilled through a subterranean formation using a drill string having a drill bit on the lower end thereof, characterized in that the device comprises:

(a) a receptacle for a cylindrically gathered pack of flexible tubing and (b) a radially expandable locking means having means for directly or indirectly attaching a first end of the tubing of the gathered pack wherein (ii) the receptacle for the gathered pack of flexible tubing is capable of being supported around the outside of the drill string at or near the lower end thereof on a plurality of bearings thereby allowing the receptacle to remain stationary while the drill string is rotated; and (iii) the radially expandable locking means is capable of being expanded against the wellbore wall thereby locking the first end of the flexible tubing in place in the wellbore such that in use movement of the drill string through the wellbore as it is being drilled causes the flexible tubing to be withdrawn from the cylindrically gathered pack and to be turned inside out thereby providing a liner for the wellbore wall with the outer surface of the tubing of the cylindrically gathered pack forming the inner surface of the liner.

The present invention includes a device for lining the wall of a wellbore as it is being drilled through a subterranean formation using a drill string having a drill bit on the lower end thereof, characterized in that the device comprises (i) a cylindrically gathered pack of flexible tubing, (ii) a receptacle for the gathered pack and (iii) a radially expandable locking means having a first end of the tubing of the gathered pack connected either directly or indirectly thereto wherein the receptacle for the gathered pack of flexible tubing is supported around the outside of the drill string at or near the lower end thereof on a plurality of bearings thereby allowing the receptacle to remain stationary while the drill string is rotated; and the radially expandable locking means is disposed on the drill string such that, in use, the radially expandable locking means is expanded against the wellbore wall thereby locking the end of the flexible tubing in place in the wellbore and movement of the drill string through the wellbore as it is being drilled causes the flexible tubing to be withdrawn from the cylindrically gathered pack and to be turned inside out thereby providing a liner for the wellbore wall with the outer surface of the tubing of the cylindrically gathered pack forming the inner surface of the liner.

When drilling through a lost circulation zone, the radially expandable means is radially expanded against the wellbore above the lost circulation zone such that as the drill string moves down through the lost circulation zone, the wellbore is lined.

For avoidance of doubt, the device of the present invention may be used to drill a side track or lateral well in addition to drilling a substantially vertical wellbore.

Suitably, the flexible tubing is withdrawn from the bottom of the cylindrically gathered pack as the wellbore is being drilled and is subsequently turned inside out to form a sleeve or liner for the wellbore. Thus, the outer surface of the flexible tubing in the gathered pack becomes the cylindrical inner surface of the liner. Suitably, the receptacle is arranged around the outside of the drill string immediately above the drill bit. Preferably, the receptacle for the gathered pack comprises an inner tube and an outer tube with the gathered pack of flexible tubing stored in the annular space formed between the inner and outer tubes and the drill string passing through the interior of the inner tube. Suitably, the inner tube of the receptacle is provided with a plurality of bearings, for example, roller bearings thereby allowing the drill string to rotate whilst the receptacle remains stationary relative to the drill string. Suitably, the roller bearings are distributed along the length of the inner tube of the receptacle. As the drill bit drills the borehole through the lost circulation zone, the first end of the tubing that is being withdrawn from the gathered pack remains locked in place in the wellbore above the lost circulation zone through expansion of the locking means against the wellbore wall whilst the drill string and the receptacle that is supported at or near the lower end thereof moves through the wellbore as it is being drilled. Thus, movement of the drill string through the wellbore causes the flexible tubing to be withdrawn from the gathered pack and to be turned inside out thereby forming the liner for the wellbore.

Suitably, the cylindrically gathered pack of tubing is formed from a flexible, non-resilient material, for example, a plastic material. The material forming the tubing is resistant to the well environment, i.e. temperature, pressure, well fluids, and the like. The material is also impermeable to wellbore liquids such as crude oil, water and gas field condensate. However, the material may be partially or fully permeable to natural gas. Examples of suitable plastic materials include polyvinylchloride (PVC), polyamides (for example, polyamide 11) and high density polyethylene (HDPE).

Preferably, the tubing of the gathered pack has a wall thickness of 0.1 to 2 mm.

The liner is held against the wellbore wall to seal the wellbore wall owing to a pressure differential that exists across the liner. Accordingly, the diameter of the flexible tubing should correspond to the inner diameter of the wellbore that is being drilled. The outer diameter of the tubing of the gathered pack may be in the range 4 to 12 inches (10 to 30 cm), preferably 6 to 10 inches (15 to 25 cm), more preferably 8 to 9 inches (20 to 23 cm), for example, 8.5 inches (21.6 cm), depending on the inner diameter of the wellbore that is being drilled.

The length of the flexible tubing in the gathered pack should be at least as long as the section of wellbore that is to be drilled through the lost circulation zone. Suitably, the length of the flexible tubing of the gathered pack is in the range 30 to 5000 feet (9 to 1524 m) depending on the length of the lost circulation zone.

Where the gathered pack of flexible tubing is stored in the annular space formed between the inner and outer tubes of the receptacle, it is preferred that the top of the receptacle is closed. Suitably, the bottom of the receptacle may comprise a ring base that supports the gathered pack of tubing and has sufficient clearance to enable the tubing be withdrawn from the gathered pack. Suitably, the clearance is provided at or near the outer wall of the tubular container. Preferably, the ring base is angled downwardly thereby acting as a guide means for the flexible tubing. For example the ring may be flared outwardly from at or near the inner wall of the tubular container. It is also envisaged that the upper end of the gathered pack may be locked or fixed in place in the upper end of the receptacle in which case the ring base may be omitted. Preferably, the outer tube is provided with a guide means to assist in turning the flexible tubing inside out as it emerges from the base of the receptacle such that the outer surface of the flexible tubing in the pack forms the inner surface of the liner that seals the wellbore. Suitably, the liner is held against the wellbore wall owing to a pressure differential that exists across the liner. Thus, the pressure in the annulus that is formed between the liner and the drill string, $P_1$, is greater than the pressure in the formation, $P_2$. Suitably the pressure differential, $\Delta P$, across the liner, (where $\Delta P=P_1-P_2$) is at least 100 psi (0.7 Mpa), preferably, in the range 100 to 2000 psi (0.7 to 14 Mpa). Furthermore, the pressure at the cutting surfaces of the drill bit, $P_3$, is greater than the pressure in the annulus, $P_1$, thereby assisting in turning the flexible tubing inside out to form the liner.

The first end of the tubing that is withdrawn from the gathered pack is connected either directly or indirectly to the radially expandable locking means such that expansion of the locking means against the wellbore wall locks the end of the tubing in place in the wellbore. An annulus is provided between the expanded locking means and the drill string thereby allowing the drill string to move through the interior of the expanded locking means. Suitably, the annulus has a radial width of at least 0.5 inch (1.3 cm), preferably at least 1 inch (2.5 cm) such that there is sufficient clearance for the drill string to move downwardly through the expanded locking means. Suitably, the radially expandable locking means and hence the end of the tubing that is withdrawn from the gathered pack is locked in place in the wellbore immediately above a loss circulation zone of the formation. The radially expandable locking means may be expanded using any suitable means known to the person skilled in the art. Typically, the radially expandable locking means is hydraulically expanded using the fluid that is pumped through the interior of the drill string. For example, the radially expandable locking means may be expanded by diverting the fluid to the radially expandable locking means such that the locking means is hydraulically expanded against the wellbore wall. Suitably, a ball may be dropped down the drill string to sit on a ring seal provided in the interior of the drill string thereby activating a one-way valve that is in fluid communication with the radially expandable locking means. As the fluid is pumped down the drill string at a predetermined first pressure, the fluid will pass to the expandable locking means via the one-way valve thereby hydraulically expanding the locking means against the wellbore wall. Thus, the predetermined first pressure matches the pressure required to expand the locking means against the wellbore wall. Once the locking means has been radially expanded, the pressure of the fluid that is being pumped down the drill string is increased to a predetermined second pressure such that the ball that is seated on the ring seal is pushed downwardly into a catching means and flow of fluid through the drill string to the drill bit is resumed. Preferably, the end of the tubing that is withdrawn from the gathered pack is locked in place in the wellbore by being sandwiched between the wellbore wall and the expanded locking means. Suitably, the radially expandable locking means comprises a length of expandable steel tubing arranged around the outside of the drill string. Preferably, the end of the tubing withdrawn from the gathered pack is attached to the outer surface of the expandable steel tubing, for example, using a suitable adhesive. Preferably, the expandable steel tubing has a length in the range 0.5 to 5 feet (15 to 152 cm), preferably 0.5 to 1.5 feet (15 to 46 cm). Diversion of the fluid through the one-way valve will hydraulically expand the expandable steel tubing against the wellbore wall thereby sandwiching the plastic tubing between the wellbore wall and the expanded steel tubing with an annulus being formed between the expanded steel tubing and the drill string. The one-way valve is subsequently deactivated, for example, as described above and the flow of the fluid is redirected to the drill bit.

The drilling fluid is passed from the surface through the interior of the drill string at a pressure, $P_4$, to ports provided in the drill bit and out over the cutting surfaces where the cuttings are entrained in the drilling fluid. There is a pressure drop over the drill bit such that the pressure, $P_3$, at the cuttings surfaces of the drill bit is less than the pressure, $P_4$, in the interior of the drill string. The drilling fluid having cuttings entrained therein (hereinafter "entrained cuttings stream") is prevented from passing directly back to the surface over the outside of the drill string owing to the fluid barrier imposed by the withdrawn flexible tubing. Accordingly, a fluid by-pass is provided for the entrained cuttings stream. For example, the interior of the drill string may be provided with at least one conduit having an inlet below the cylindrical receptacle for the gathered pack of tubing and an outlet above the cylindrical receptacle such that the entrained cuttings stream passing through the conduit bypasses the cylindrical receptacle. Alternatively, the cylindrical receptacle may itself be provided with a fluid by-pass.

The entrained cuttings stream then flows to the surface through the annulus formed about the drill string in the standard manner.

In a further aspect of the present invention there is a provided a method of sealing the wall of a wellbore as it is being drilled through a subterranean formation using a drill string having a drill bit on the lower end thereof which method comprises fitting the device of the present invention comprising the receptacle, the gathered pack of tubing and the radially expandable locking means to the lower end of the drill string and drilling a first section of wellbore, expanding the locking means against the wellbore wall such that the first end of the tubing that is withdrawn from the gathered pack is locked in place in the wellbore, drilling a second section of wellbore with the movement of the drill string through the wellbore causing the tubing to be withdrawn from the gathered pack and to be turned inside out thereby forming a liner for the second section of wellbore.

As discussed above, during drilling of the first and second wellbore sections, a drilling fluid is passed through the interior of the drill string and through at least one port in the drill bit to the cuttings surfaces of the drill bit where the drill cuttings are entrained in the drilling fluid. The resulting entrained cuttings stream then flows through a fluid by-pass for the cylindrical receptacle and into the annulus formed about the drill string.

The present invention will now be illustrated by reference to the FIGURE.

A wellbore 1 is drilled to above a lost circulation zone 2 of a formation using a drill string 3 having a drill bit 4 on the lower end thereof. A receptacle 5 for a cylindrically gathered pack of tubing 6 is supported around the lower end of the drill string 2 on a plurality of roller bearings 7. A first end of the gathered pack of tubing 6 is connected to a radially expandable locking means 8 and is locked in place in the wellbore 1 at a position immediately above the lost circulation zone 2 by being sandwiched between expanded locking means 8 and the wellbore wall. Drilling fluid is passed from the surface through the interior of the drill string 3 at a pressure, $P_4$, to ports 9 in the drill bit 4 and out over the cutting surfaces of the drill bit. A pressure drop exits over the drill bit such that the pressure, $P_3$, at the cutting surfaces of the drill bit 4 is less than pressure $P_4$, in the interior of the drill string. Drilling fluid having cuttings entrained therein passes from the drill bit 4 to annulus 10 through a fluid by-pass 11 which has inlets 13 and outlets 14. A pressure drop exits over the fluid by-pass such that the pressure, $P_3$, at the cutting surfaces of the drill bit 4 is greater than the pressure, $P_1$, in the annulus 10. As the drill bit drills a continuation of the wellbore 1 through the lost circulation zone 2, tubing is withdrawn from the gathered pack 5 and passes over guide mans 12 before being turned inside out to form a liner for the wellbore 1. The liner is held against the wellbore wall owing to the pressure $P_1$, in the annuls 10 being greater than the pressure, $P_2$, in the lost circulation zone 2 of the formation. Thus, the pressure of the drilling fluid passing through the interior of the drill string, $P_4$, is maintained at a sufficiently high value that the pressure $P_1$, in the annulus 10 is maintained at a higher pressure than the pressure of the lost circulation zone 2 of the formation, $P_2$ (i.e. $P_4>P_3>P_1>P_2$).

The invention claimed is:

1. A device for lining the wall of a wellbore as it is being drilled through a subterranean formation using a drill string having a drill bit on the lower end thereof, said device comprising:

(a) a receptacle for a cylindrically gathered pack of flexible tubing;

(b) a radially expandable locking means having means for directly or indirectly attaching a first end of the tubing of the gathered pack; and (c) a plurality of bearings for supporting the receptacle for the gathered pack of flexible tubing around the outside of the drill string at or near the lower end thereof thereby allowing the receptacle to remain stationary while the drill string is rotated;

wherein the radially expandable locking means is capable of being expanded against the wellbore wall thereby locking the first end of the flexible tubing in place in the wellbore such that in use movement of the drill string through the wellbore as it is being drilled causes the flexible tubing to be withdrawn from the cylindrically gathered pack and to be turned inside out thereby providing a liner for the wellbore wall with the outer surface of the tubing of the cylindrically gathered pack forming the inner surface of the liner.

2. A device for lining the wall of a wellbore as it is being drilled through a subterranean formation using a drill string having a drill bit on the lower end thereof, wherein the device comprises (i) a cylindrically gathered pack of flexible tubing, (ii) a receptacle for the gathered pack and (iii) a radially expandable locking means having a first end of the tubing of the gathered pack connected either directly or indirectly thereto wherein the receptacle for the gathered pack of flexible tubing is supported around the outside of the drill string at or near the lower end thereof on a plurality of bearings thereby allowing the receptacle to remain stationary while the drill string is rotated and the radially expandable locking means is disposed on the drill string such that, in use, the radially expandable locking means is expanded against the wellbore wall thereby locking the end of the flexible tubing in place in the wellbore and movement of the drill string through the wellbore as it is being drilled causes the flexible tubing to be withdrawn from the cylindrically gathered pack and to be turned inside out thereby providing a liner for the wellbore wall with the outer surface of the tubing of the cylindrically gathered pack forming the inner surface of the liner.

3. A device as claimed in claim 2 in which the flexible tubing is polyvinylchloride, polyamide or high density polyethylene.

4. A device as claimed in claim 2 in which the flexible tubing has a wall thickness of 0.1 to 2 mm.

5. A device as claimed in claim 2 in which there is at least one conduit within the drill string, each conduit having an inlet below the receptacle for the gathered pack of flexible tubing and an outlet above the cylindrical receptacle.

6. A method of sealing the wall of a wellbore as it is being drilled through a subterranean formation using a drill string having a drill bit on the lower end thereof which method comprises fitting a device as claimed in claim 1, comprising a receptacle, a gathered pack of tubing and a radially expandable locking means, to the lower end of a drill string and drilling a first section of wellbore, expanding the locking means against the wellbore wall such that the first end of the tubing that is withdrawn from the gathered pack is locked in place in the wellbore, drilling a second section of wellbore with the movement of the drill string through the wellbore causing the tubing to be withdrawn from the gathered pack and to be turned inside out thereby forming a liner for the second section of wellbore.

7. A method as claimed in claim 6 in which the locking means is expanded against the wellbore at a position immediately above a lost circulation zone of the formation that it is desired to seal.

* * * * *